US009073310B2

(12) United States Patent
Kudo et al.

(10) Patent No.: US 9,073,310 B2
(45) Date of Patent: Jul. 7, 2015

(54) PRINTHEAD SUBSTRATE, PRINTHEAD, AND PRINTING APPARATUS

(71) Applicant: CANON KABUSHIKI KAISHA, Tokyo (JP)

(72) Inventors: Tomoko Kudo, Kawasaki (JP); Nobuyuki Hirayama, Fujisawa (JP); Kengo Umeda, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 104 days.

(21) Appl. No.: 13/891,437

(22) Filed: May 10, 2013

(65) Prior Publication Data

US 2013/0314464 A1 Nov. 28, 2013

(30) Foreign Application Priority Data

May 25, 2012 (JP) ..... 2012-120135

(51) Int. Cl.
*B41J 29/38* (2006.01)
*B41J 2/045* (2006.01)

(52) U.S. Cl.
CPC ..... *B41J 2/04541* (2013.01); *B41J 2/04543* (2013.01); *B41J 2/0458* (2013.01); *B41J 2/04591* (2013.01)

(58) Field of Classification Search
CPC .. B41J 2/04591; B41J 2/0459; B41J 2/04588; B41J 2/0457; B41J 2/0452; B41J 2/04541; B41J 2/04543; B41J 2/04545; B41J 2/04548; B41J 2/0455
See application file for complete search history.

(56) References Cited

U.S. PATENT DOCUMENTS

| | | | | |
|---|---|---|---|---|
| 7,850,262 | B2 | 12/2010 | Hirayama et al. | |
| 2001/0033305 | A1* | 10/2001 | Tamura | 347/19 |
| 2011/0122181 | A1 | 5/2011 | Kasai et al. | |
| 2013/0010021 | A1 | 1/2013 | Umeda | |
| 2013/0208037 | A1 | 8/2013 | Hirayama | |

FOREIGN PATENT DOCUMENTS

JP 2007-022069 A 2/2007

OTHER PUBLICATIONS

U.S. Appl. No. 13/914,918, filed Jun. 11, 2013.

* cited by examiner

*Primary Examiner* — Stephen Meier
*Assistant Examiner* — Renee I Wilson
(74) *Attorney, Agent, or Firm* — Fitzpatrick, Cella, Harper & Scinto

(57) ABSTRACT

A printing element substrate, comprising a plurality of printing elements which form a plurality of groups, a first generating unit configured to generate a threshold signal set for each of the plurality of groups and a ramp signal, based on an externally received digital signal, and second generating units, which are arranged in correspondence with the respective groups, configured to generate, based on the ramp signal and the threshold signal, enable signals for setting a period during which the printing element is driven.

8 Claims, 22 Drawing Sheets

PRINTHEAD SUBSTRATE, PRINTHEAD, AND PRINTING APPARATUS

BACKGROUND OF THE INVENTION

1. Field of the Invention

The present invention relates to a printhead substrate, printhead, and printing apparatus.

2. Description of the Related Art

A printhead substrate can include a plurality of printing elements. The respective printing elements desirably have the same characteristics. For example, Japanese Patent Laid-Open No. 2007-022069 discloses a layout which equalizes voltages to be supplied to drive respective printing elements. Specifically, a transistor and resistor among circuits for generating such voltages are arranged at different positions. More specifically, the transistor is arranged in at least one of driving circuits (driver transistor, logic circuit, and booster circuit), and the resistor is interposed between the driving circuit and the side of a printhead substrate. According to Japanese Patent Laid-Open No. 2007-022069, this layout reduces the resistance component of a power supply wiring line, and equalizes voltages to be supplied to respective printing elements.

FIG. 14 shows the section of a printing element forming a heater HT. The heater HT can include an electric wiring layer 51, protective insulating film 52, and anti-cavitation film 53. An energy value necessary to drive the printing element can differ between printing elements owing to manufacturing variations such as differences in these film thicknesses between the printing elements. However, as a heat enable signal HE for driving the printing element, a common signal can be used for the entire chip or respective groups each including a plurality of printing elements. The load therefore differs between the printing elements.

SUMMARY OF THE INVENTION

The present invention provides a technique advantageous for preventing characteristic variations of a plurality of printing elements.

One of the aspects of the present invention provides a printing element substrate, comprising a plurality of printing elements which form a plurality of groups, a first generating unit configured to generate a threshold signal set for each of the plurality of groups and a ramp signal, based on an externally received digital signal, and second generating units, which are arranged in correspondence with the respective groups, configured to generate, based on the ramp signal and the threshold signal, enable signals for setting a period during which the printing element is driven.

Further features of the present invention will become apparent from the following description of exemplary embodiments with reference to the attached drawings.

DESCRIPTION OF THE EMBODIMENTS

Preferred embodiments of the present invention will now be described in detail with reference to the accompanying drawings. In the following description, a printing apparatus using an inkjet printing method will be exemplified. The printing apparatus may be, for example, a single-function printer having only the printing function, or a multi-function printer having a plurality of functions such as the printing function, FAX function, and scanning function. The printing apparatus may be a manufacturing apparatus for manufacturing a color filter, electronic device, optical device, microstructure, or the like by a predetermined printing method.

In the following description, "print" not only includes the formation of significant information such as characters and graphics, but also broadly includes the formation of images, designs, patterns, structures, and the like on a printing medium, or processing of the medium, regardless of whether they are significant or insignificant and whether they are so visualized as to be visually perceived by humans.

Also, a "printing medium" not only includes paper used in general printing apparatuses, but also includes materials capable of accepting ink, such as cloth, plastic film, metal plate, glass, ceramics, resin, wood, and leather.

Also, "ink" should be broadly interpreted, similar to the definition of "print" described above. "Ink" includes a liquid which, when applied onto a printing medium, can form images, designs, patterns, and the like, can process the printing medium, or can be used for ink processing (for example, solidification or insolubilization of a coloring material contained in ink to be applied to a printing medium).

Figure 1:
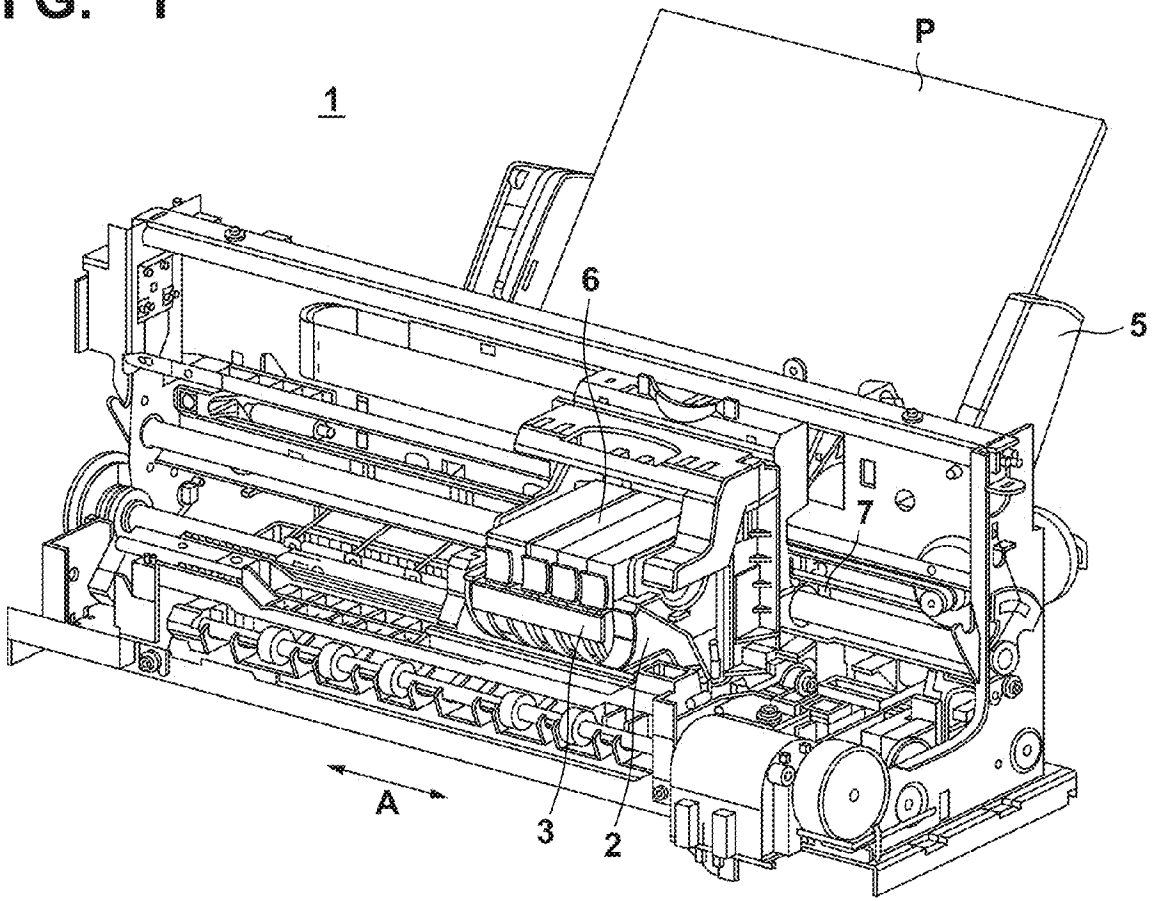
FIG. 1 is a perspective view exemplifying the outer appearance of an inkjet printing apparatus 1 according to an embodiment of the present invention.

FIG. 1 is a perspective view exemplifying the outer appearance of an inkjet printing apparatus 1 according to an embodiment of the present invention.

In the inkjet printing apparatus (to be referred to as a printing apparatus hereinafter) 1, an inkjet printhead (to be referred to as a printhead hereinafter) 3 for discharging ink according to an inkjet method to print is mounted on a carriage 2. The carriage 2 reciprocates in directions indicated by an arrow A to print. The printing apparatus 1 feeds a printing medium P such as printing paper via a sheet supply mechanism 5, and conveys it to a printing position. At the printing position, the printhead 3 discharges ink onto the printing medium P, thereby printing.

In addition to the printhead 3, for example, ink cartridges 6 are mounted on the carriage 2 of the printing apparatus 1. Each ink cartridge 6 stores ink to be supplied to the printhead 3. The ink cartridge 6 is detachable from the carriage 2.

The printing apparatus 1 shown in FIG. 1 is capable of color printing. For this purpose, four ink cartridges which contain magenta (M), cyan (C), yellow (Y), and black (K) inks are mounted on the carriage 2. These four ink cartridges are independently detachable.

The printhead 3 according to the embodiment adopts, for example, an inkjet method of discharging ink using thermal energy. The printhead 3 includes electrothermal transducers. The electrothermal transducers are arranged in correspondence with respective orifices. A pulse voltage is applied to an electrothermal transducer corresponding to a printing signal, thereby discharging ink from a corresponding orifice. In the embodiment, discharge of ink using a heater will be explained as an ink discharge method, but the present invention is not limited to this. The present invention may employ various inkjet methods such as a method using a piezoelectric element, a method using an electrostatic element, and a method using a MEMS element.

Figure 2:
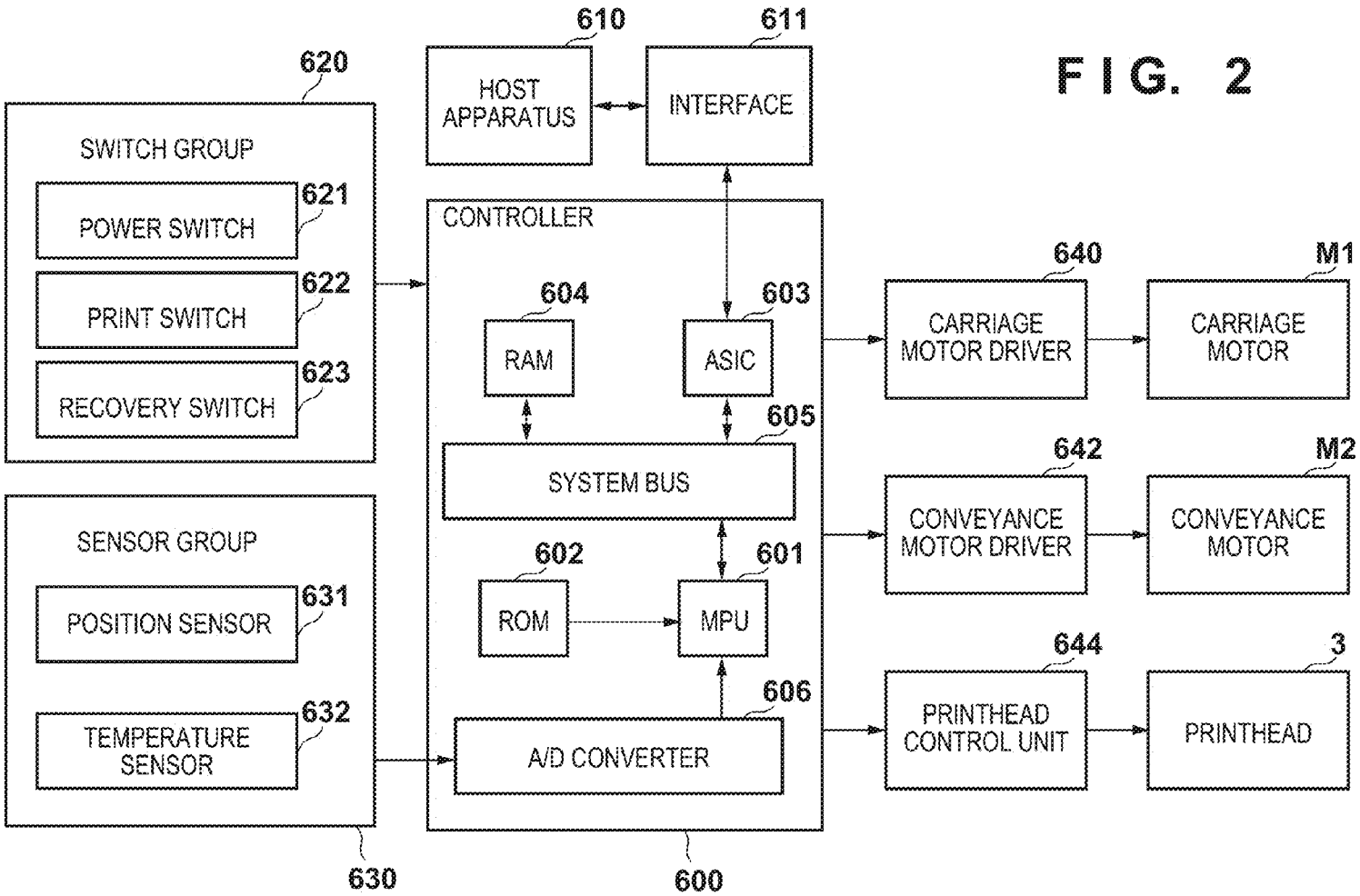
FIG. 2 is a block diagram exemplifying the functional arrangement of the printing apparatus 1 shown in FIG. 1.

FIG. 2 is a block diagram exemplifying the functional arrangement of the printing apparatus 1 shown in FIG. 1.

A controller 600 includes an MPU 601, ROM 602, application specific integrated circuit (ASIC) 603, RAM 604, system bus 605, and A/D converter 606.

The ROM 602 stores programs corresponding to control sequences (to be described later), necessary tables, and other permanent data. The ASIC 603 controls a carriage motor M1 and conveyance motor M2. Also, the ASIC 603 generates a control signal for controlling the printhead 3. The RAM 604 is used as an image data rasterization area, a work area for executing a program, and the like. The system bus 605 connects the MPU 601, ASIC 603, and RAM 604 to each other to exchange data. The A/D converter 606 A/D-converts an analog signal input from a sensor group (to be described later), and supplies the converted digital signal to the MPU 601.

A switch group 620 includes a power switch 621, print switch 622, and recovery switch 623. A sensor group 630 is used to detect an apparatus state, and includes a position sensor 631 and temperature sensor 632. When scanning the printhead 3, the ASIC 603 transfers, to the printhead 3, data for driving printing elements while directly accessing the storage area of the RAM 604.

The carriage motor M1 is a driving source for reciprocally scanning the carriage 2 in directions indicated by the arrow A. A carriage motor driver 640 controls driving of the carriage motor M1. The conveyance motor M2 is a driving source for conveying the printing medium P. A conveyance motor driver 642 controls driving of the conveyance motor M2.

The printhead 3 is scanned in a direction (to be referred to as a scanning direction hereinafter) perpendicular to the conveyance direction of the printing medium P. More specifically, the printhead 3 is scanned relatively to the printing medium.

A computer (or a reader for reading an image, a digital camera, or the like) 610 serves as an image data supply source, and is generically called a host apparatus or the like. The host apparatus 610 and printing apparatus 1 exchange image data, commands, status signals, and the like via an interface (I/F) 611.

REFERENCE EXAMPLE

Figure 3A:
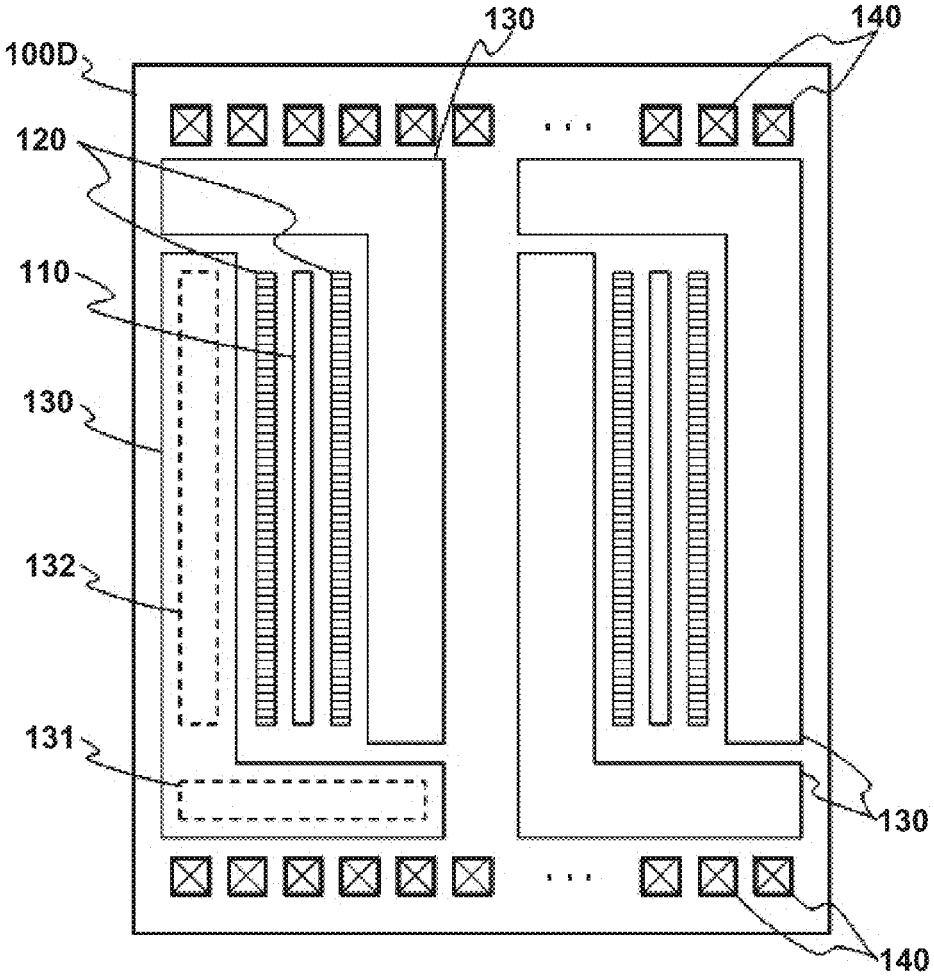
FIGS. 3A to 3D are views for explaining a reference example of a printhead substrate.

A reference example of the arrangement and driving method of a printhead substrate will be described prior to a description of each embodiment. FIG. 3A is a block diagram schematically showing the arrangement of a printhead substrate 100D (to be referred to as a "substrate 100D" hereinafter). The substrate 100D has, for example, a rectangular shape. The substrate 100D can include ink supply channels 110. Although FIG. 3A exemplifies two ink supply channels 110, the substrate 100D may include one or three or more ink supply channels 110. The ink supply channel 110 is arranged so that its long side runs along the direction of the side (long or short side) of the substrate 100D. The substrate 100D further includes heater arrays 120 and control units 130. Each heater array 120 includes a plurality of printing elements ME, and each printing element ME includes a heater (electrothermal transducer) and driving element. The ink supply channel 110 has, for example, a rectangular shape, and supplies ink to the respective printing elements ME. In the heater array 120, the plurality of printing elements ME are arranged in line along two long sides of the ink supply channel 110. A plurality of pads 140 are arranged along sides of the substrate 100D.

Each control unit 130 includes, for example, an input unit 131 for inputting a signal, and a driving unit 132 for selecting and driving each printing element ME of the heater array 120. A control signal, for example, a heat enable signal HE externally input via the pad 140 is input to the driving unit 132 via the input unit 131. As a method of inputting the heat enable signal HE, a signal common to the entire substrate is input, signals different between the heater arrays 120 are input, or the entire substrate is divided into a plurality of regions to input signals to the respective regions. A case in which the heat enable signal HE is input to each heater array 120 will be described. The driving unit 132 can drive each selected printing element ME for a time corresponding to the pulse width of the heat enable signal HE. In this manner, the control unit 130 controls the operation of each printing element ME. A more detailed example will be explained with reference to FIG. 3B.

Figure 3B:
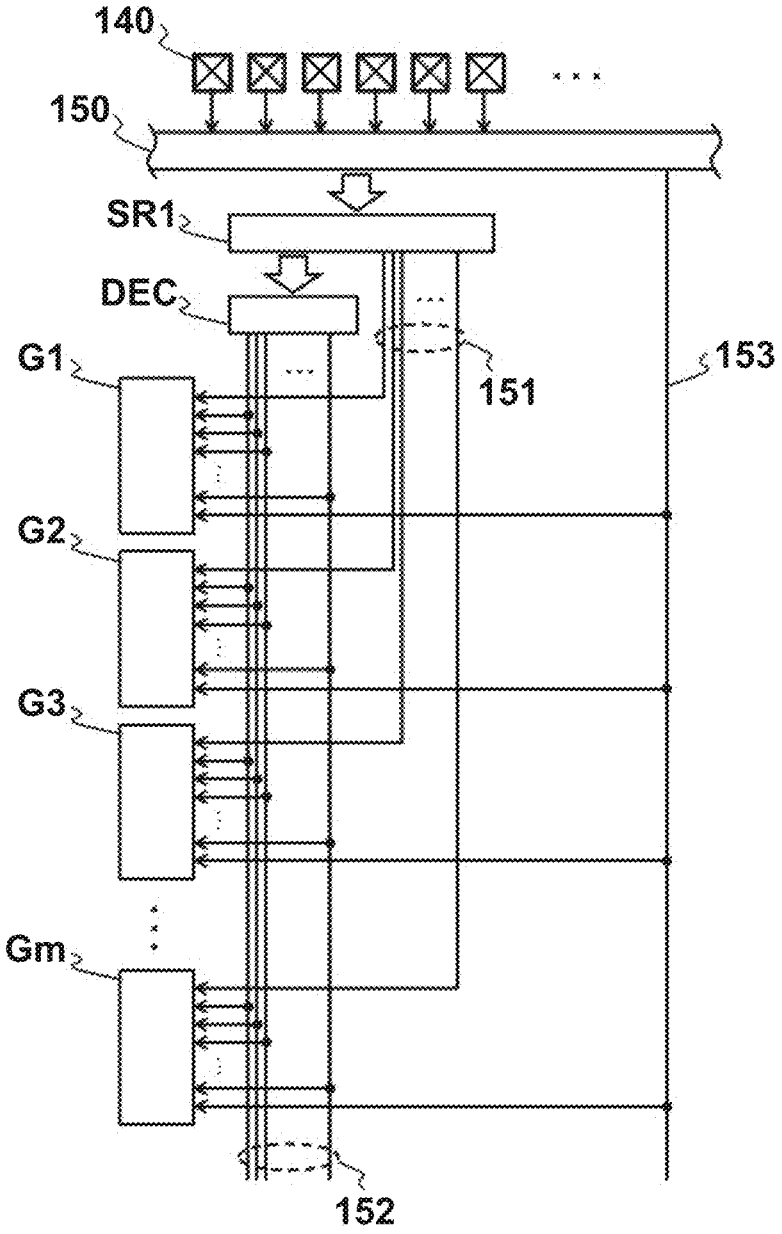
Figure 3C:
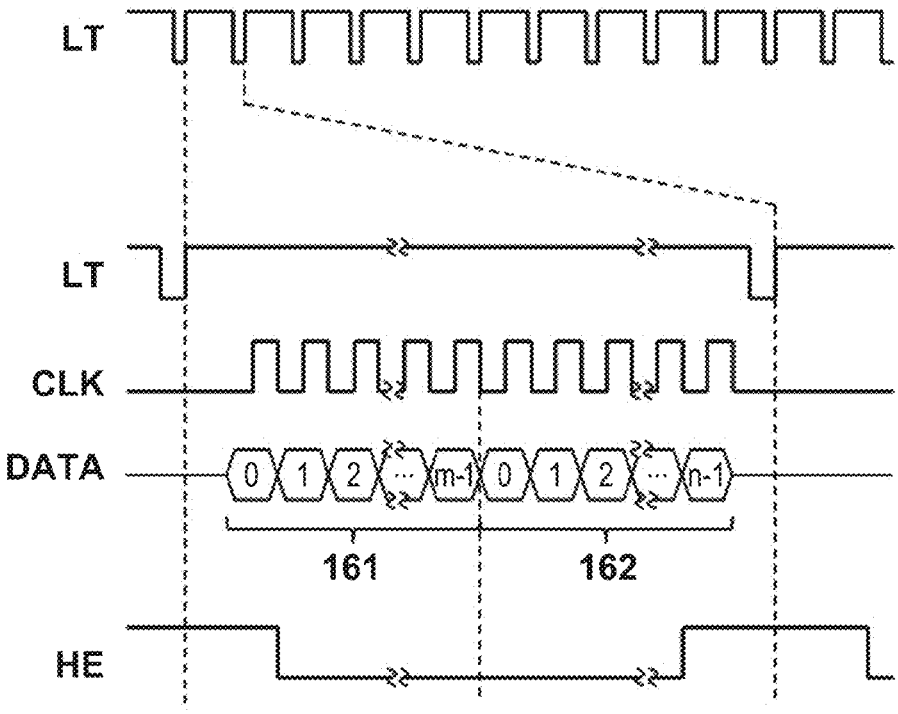

FIG. 3B schematically exemplifies the circuit arrangements of the heater array 120 and control unit 130. An input circuit 150, shift register SR1, and decoder DEC which form the control unit 130, and a plurality of groups G1 to Gm which form the heater array 120 are arranged. The groups G1 to Gm will be collectively called groups G. In addition to the heat enable signal HE, a clock signal CLK, a latch signal LT, and a signal containing print data DATA are input to the control unit 130 via the pads 140. These signals are input to the shift register SR1 and decoder DEC via the input circuit 150. The clock signal CLK is a signal input to the shift register SR1. A state (information) held by each register of the shift register SR1 shifts to a register at the next stage in accordance with the clock signal CLK. The latch signal LT is a signal for initializing the shift register SR1. The substrate 100D is driven according to, for example, a timing chart as exemplified in FIG. 3C. The print data DATA contains a print data signal 161 and time division signal 162, which are held by the shift register SR1. The print data signal 161 is input to the respective groups G via print data signal lines 151. The decoder DEC decodes the time division signal 162 into time division selection signal 162S. The time division selection signal 162S is input to the respective groups G via time division signal lines 152. The heat enable signal HE is input to the respective groups G via an HE signal line 153. FIG. 3C is an enlarged view showing the clock signal CLK, print data DATA, and heat enable signal HE in the period of one pulse of the latch signal LT.

Figure 3D:
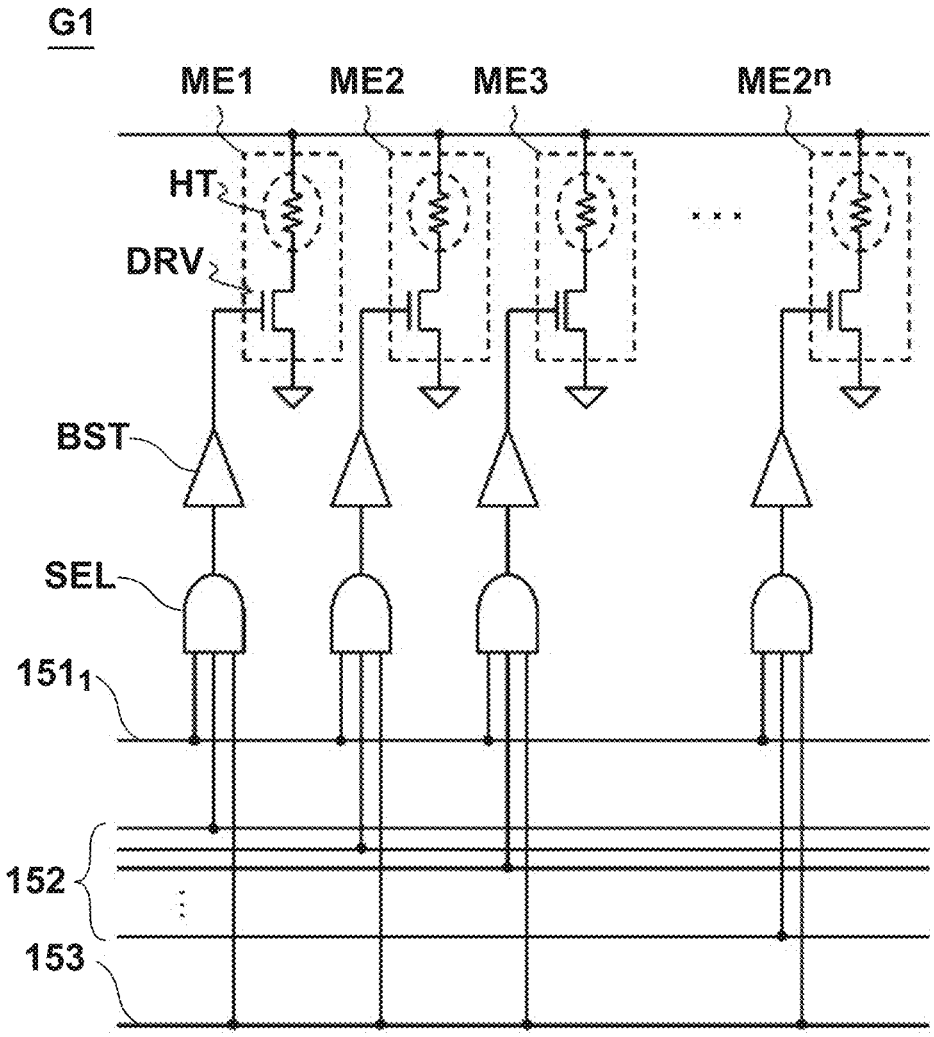

As shown in FIG. 3D, each group G can include a plurality of printing elements ME, that is, ME1 to ME2$^n$, and voltage conversion circuits BST and selection circuits SEL which are arranged in correspondence with the respective printing elements ME. Each selection circuit SEL receives the heat enable signal HE via the HE signal line 153, the print data signal 161 via the print data signal line 151, and the time division signal 162 via the time division signal line 152. An output from the selection circuit SEL is boosted by the voltage conversion circuit BST and input to a driving element DRV, thereby driving the heater HT and generating heat. The heat bubbles ink, discharging an ink droplet from the orifice.

The print data signal 161 is input to the respective groups G in accordance with, for example, an image signal. For example, when the number of groups G is m, the print data signal 161 is formed from m bits, and m print data signal lines 151 are arranged. The time division signal 162 is a signal for selecting a printing element ME to be driven in one group G, and can be input to each selection circuit SEL in each group G. For example, when each group G includes $2^n$ printing elements ME, the time division signal 162 is formed from n bits, and $2^n$ time division signal lines 152 can be arranged.

For example, the first power supply voltage (for example, 24 V) is supplied to each printing element ME, and the second power supply voltage (for example, 3 V) is supplied from the input circuit 150 to the selection circuit SEL. The output value of the selection circuit SEL is converted (boosted) to the third power supply voltage (for example, 14 V) by the voltage conversion circuit BST, thereby operating the driving element DRV and driving the heater HT.

In this reference example, the common heat enable signal HE can be used in the entire chip or each group G including a plurality of printing elements ME. This reference example has a problem that the load differs between the printing elements ME owing to manufacturing variations of the respective printing elements ME. For example, the respective printing elements ME discharge different amounts of ink droplets.

First Embodiment

Figure 4:
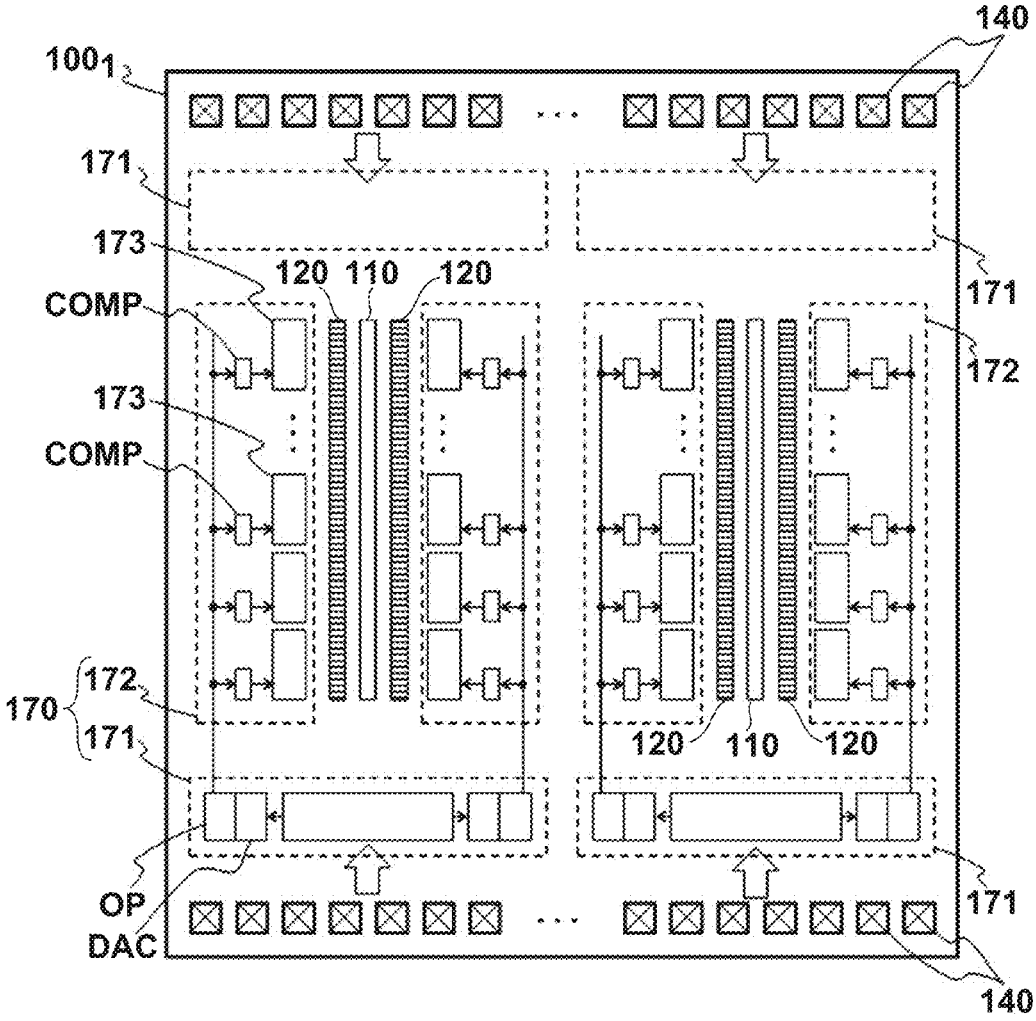
FIG. 4 is a diagram for explaining an example of the arrangement of a printhead substrate according to the first embodiment.

A printhead substrate $\mathbf{100}_1$ (to be referred to as a "substrate $\mathbf{100}_1$" hereinafter) according to the first embodiment will be explained with reference to FIGS. 4 to 8. FIG. 4 is a block diagram schematically showing the arrangement of the substrate $\mathbf{100}_1$. The substrate $\mathbf{100}_1$ is different from a substrate 100D in the arrangements of input units (reception units) 171 and driving units 172 in control units 170. Each input unit (reception unit) 171 is arranged near a side of the substrate $\mathbf{100}_1$, and each driving unit 172 is arranged along a heater array 120 in correspondence with respective groups G. A plurality of pads 140 are arranged along sides of the substrate $\mathbf{100}_1$. A control signal generated by an ASIC 603 is input to the pads 140. These components are the same as those in the above-described reference example.

The input unit 171 further includes a D/A converter DAC as the first signal generating unit. It is only necessary that at least one of the input unit 171 on the upper side of the substrate $\mathbf{100}_1$ and the input unit 171 on its lower side includes the D/A converter DAC. The driving unit 172 further includes a plurality of comparators COMP as the second signal generating units. The input unit 171 may further include an operational amplifier OP. The D/A converter DAC and operational amplifier OP are arranged near a side of the substrate $\mathbf{100}_1$. The respective comparators COMP are arranged in correspondence with the respective groups G. With the above-exemplified arrangement, the embodiment sets the HE pulse width for each printing element ME, preventing characteristic variations of a plurality of printing elements ME.

Figure 5:
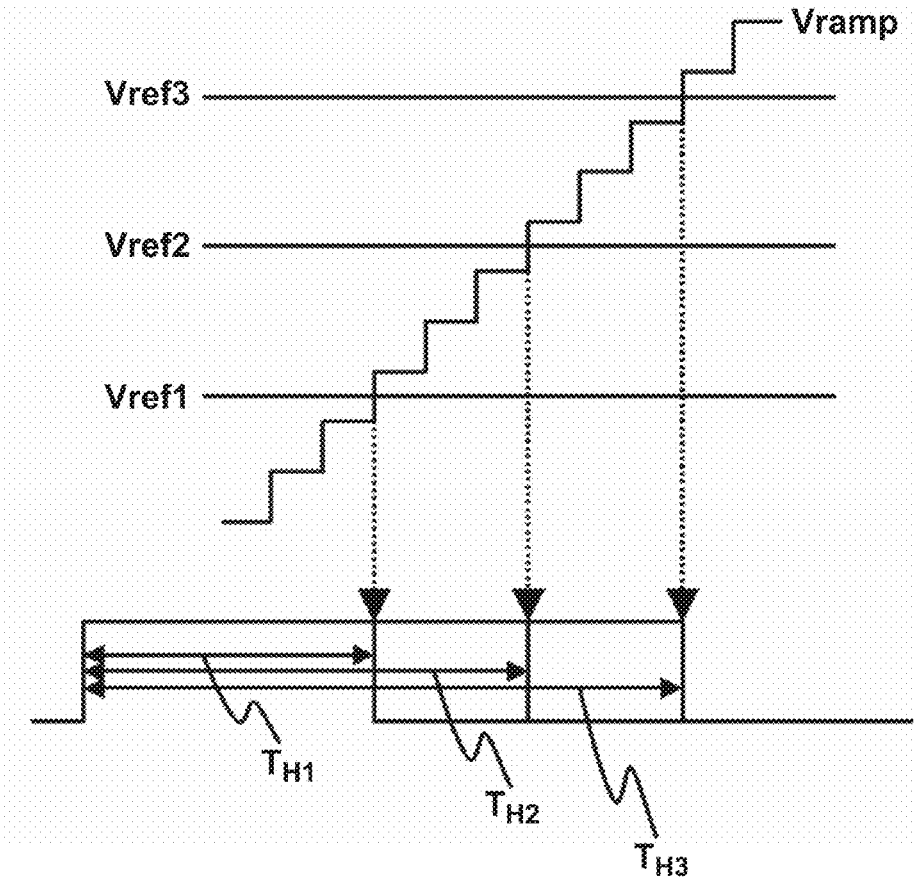
FIG. 5 is a chart for explaining a heat enable signal generation method according to the first embodiment.

The pulse width of the heat enable signal HE can be determined by, for example, comparing a predetermined reference signal and a ramp signal whose voltage changes with the lapse of time. More specifically, a reference voltage Vref (one of reference voltages Vref1 to Vref3) is set, as shown in FIG. 5. Then, a ramp signal Vramp whose voltage changes stepwise with the lapse of time is generated. After that, the time until the magnitude relationship between the potentials of these signals is reversed after the start of comparing these signals by the comparator COMP is measured. The heat enable signal HE having a pulse width complying with the measurement result can be generated. For example, as shown in FIG. 5, when the reference voltage Vref1 is set, the HE pulse width becomes $T_{H1}$. When the reference voltage Vref2 is set, the HE pulse width becomes $T_{H2}$. When the reference voltage Vref3 is set, the HE pulse width becomes $T_{H3}$. Signal lines for propagating the reference voltage Vref and ramp signal Vramp suffice to be arranged along short sides of the printing elements ME arranged in line and an ink supply channel 110.

Figure 6:
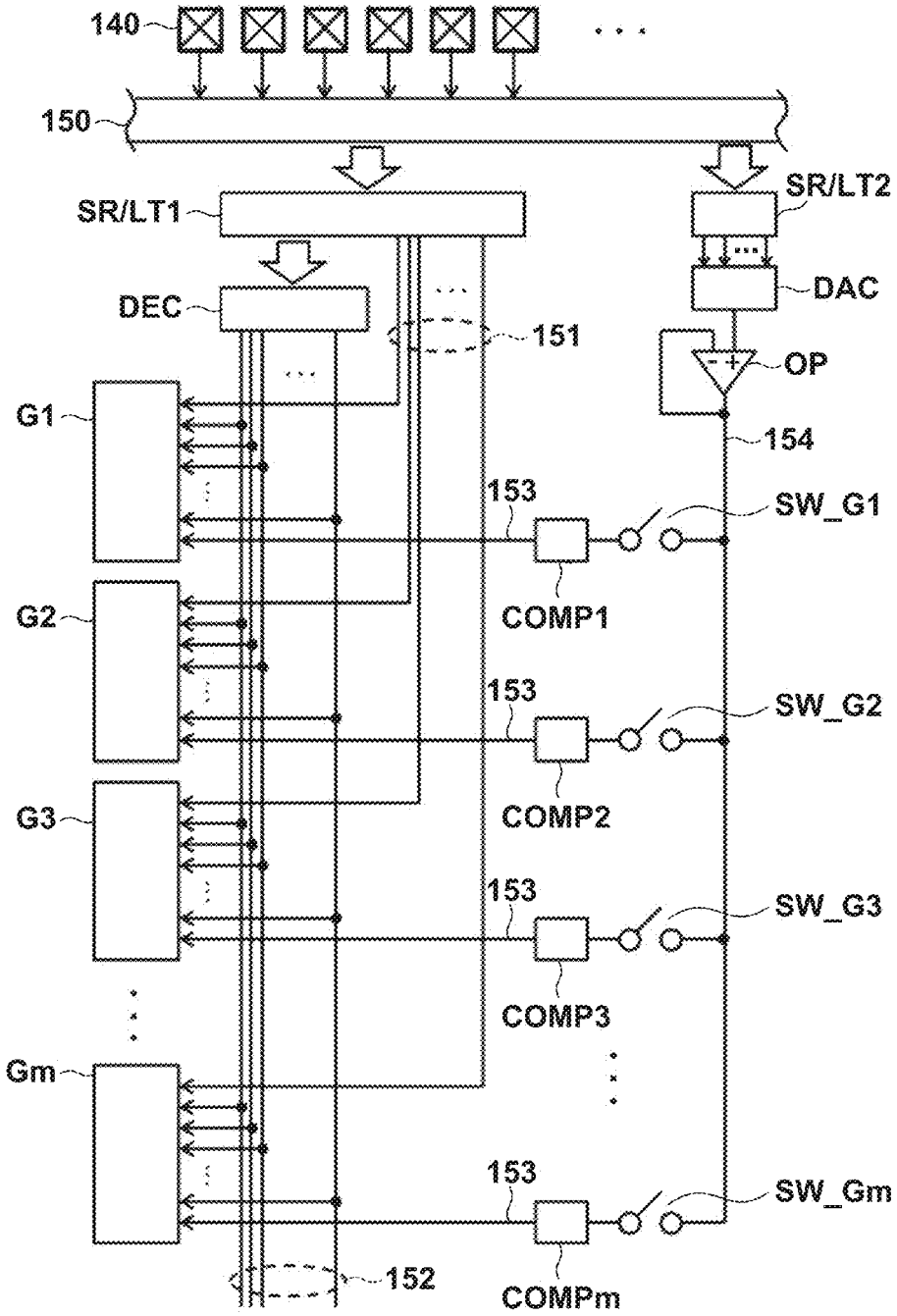
FIG. 6 is a circuit diagram for explaining an example of the circuit arrangement of the printhead substrate according to the first embodiment.

FIG. 6 schematically exemplifies the circuit arrangements of the control unit 170 and the plurality of groups G. FIG. 6 shows an input circuit 150, a shift register/latch circuit SR/LT1, a decoder DEC, the plurality of groups G, a shift register/latch circuit SR/LT2, the D/A converter DAC, the operational amplifier OP, and the comparators COMP. Comparators COMP1 to COMPm arranged in correspondence with the respective groups G will be collectively called the comparators COMP. Setting of the reference voltage Vref, generation of the ramp signal Vramp, and comparison of them can be performed by the shift register/latch circuit SR/LT2, D/A converter DAC, operational amplifier OP, and comparators COMP. Each comparator COMP is connected to a corresponding group G via a signal line 153 for transferring the heat enable signal HE. The operational amplifier OP and comparator COMP are connected by a signal line 154. An analog signal generated by the D/A converter DAC is transferred to the signal line 154. The remaining part is the same as that in the reference example. Note that the shift register/latch circuit SR/LT1 and shift register/latch circuit SR/LT2 are also expressed as so-called data holding circuits.

Data for determining the pulse width of the heat enable signal HE is contained in print data input from a pad 140 and is held by the shift register/latch circuit SR/LT2. The data is processed by the D/A converter DAC, and a signal is input to the comparators COMP, that is, COMP1 to COMPm corresponding to the respective groups G. The input capacitance is large because the plurality of comparators COMP are arranged. To ensure the response characteristic, for example, the operational amplifier OP is interposed between the D/A converter DAC and the respective comparators COMP.

Switches SW, that is, SW_G1 to SW_Gm are connected to the comparators COMP corresponding to the respective groups G. When setting the reference voltage Vref, SW_G1 to SW_Gm are turned on sequentially one by one. When inputting the ramp signal Vramp to the comparators COMP, all the switches SW_G1 to SW_Gm are turned on. When the shift register/latch circuit SR/LT2 is further divided into shift registers for the reference voltage Vref and the ramp signal Vramp, a latch circuit for the reference voltage Vref is arranged, but a latch circuit for the ramp signal Vramp may be omitted.

Figure 7A:
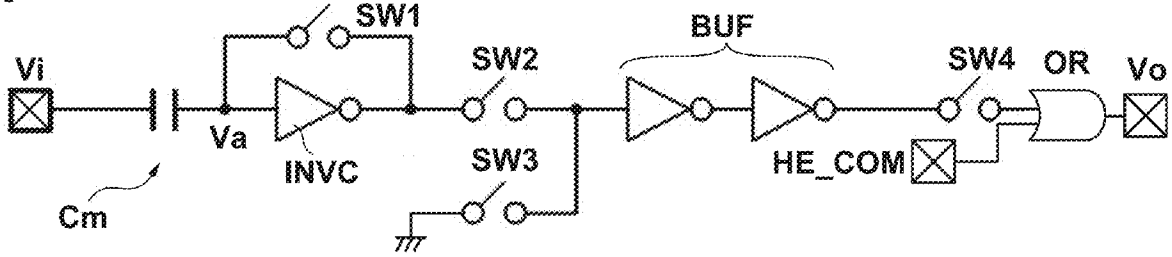
FIGS. 7A to 7D are views for explaining an example of the arrangement of a circuit which generates a heat enable signal according to the first embodiment.

FIGS. 7A to 7D exemplify the arrangement and operation of the comparator COMP. The comparator COMP includes a capacitor Cm as a memory. The capacitor Cm is connected to an inverter INVC, and a switch SW1 is interposed between the input and output of the inverter INVC. An output from the inverter INVC can be output via a buffer BUF. In addition, for example, switches SW2 to SW4 can be appropriately arranged, as shown in FIG. 7A, in order to secure the function.

Figure 7B:
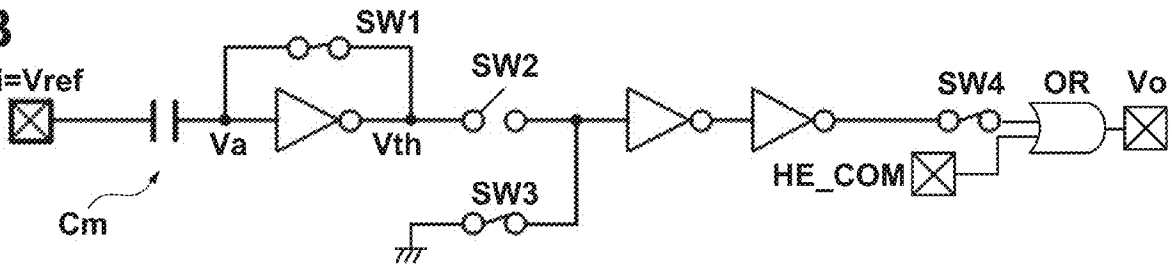
Figure 7C:
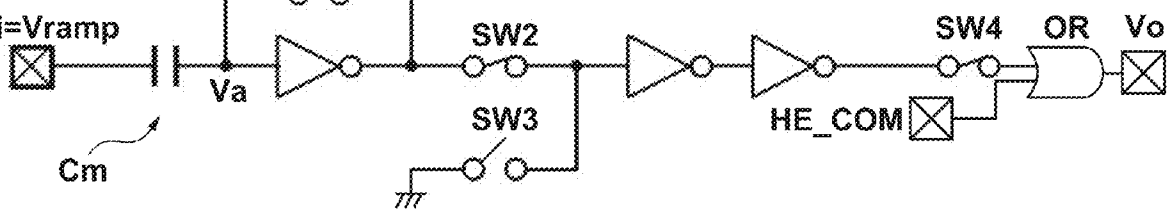
Figure 7D:
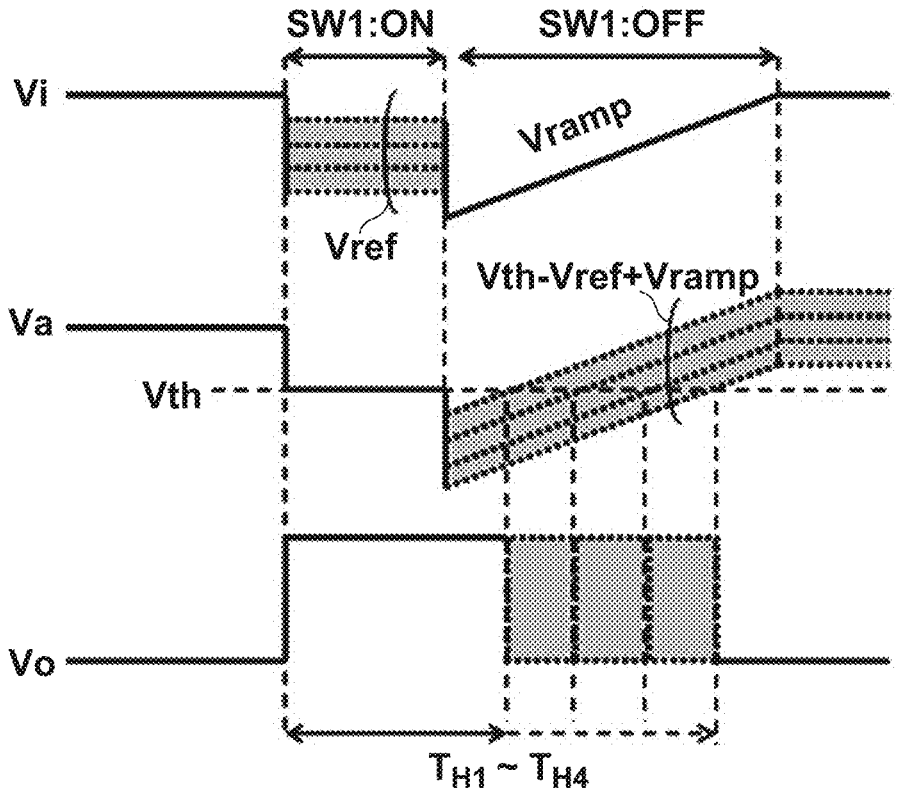

As for the switches SW1 to SW4, FIG. 7B shows a state when the reference voltage Vref is set, and FIG. 7C shows a state when the ramp signal Vramp is generated. FIG. 7D shows the waveforms of an input voltage Vi of the comparator COMP, a voltage Va of the input node of the inverter INVC, and an output voltage Vo of the comparator COMP when the comparator COMP operates.

When setting the reference voltage Vref, the switch SW1 is turned on (conductive state), and voltages at the input and output nodes of the inverter INVC become equal to each other. That is, the voltage Va becomes a threshold voltage Vth of the inverter INVC. The set reference voltage Vref (for example, one of Vref1 to Vref4) is input as the input voltage Vi. Hence, a potential difference Vth−Vref is generated in the capacitor Cm, and charges corresponding to this potential difference are stored. In this manner, the capacitor Cm can function as a memory. Since the switch SW3 is turned on (conductive state), the buffer BUF changes to the ground potential.

Then, the switch SW1 is turned off (non-conductive state), the switch SW2 is turned on (conductive state), and the switch SW3 is turned off (non-conductive state). Further, the generated ramp signal Vramp is input as the input voltage Vi. It is only necessary to set the capacitance value of the capacitor Cm so that a change (AC component) of the ramp signal Vramp can be detected. Thus, the waveform of the voltage Va is formed to be Va=Vth−Vref+Vramp, as shown in FIG. 7D. When the voltage Va exceeds the threshold voltage Vth, an output from the inverter INVC is inverted, and as a result, the output voltage Vo changes to the low state. The output voltage Vo is used as the heat enable signal HE.

As shown in FIG. 7D, the pulse width of the heat enable signal HE (output voltage Vo here) changes depending on, for example, which of Vref1 to Vref4 is set as the reference voltage Vref. For example, when the minimum reference voltage Vref1 among Vref1 to Vref4 is set as the reference voltage Vref, the pulse width of the heat enable signal HE becomes $T_{H1}$. In this way, the control unit 170 adjusts the pulse width of the heat enable signal HE to be one of $T_{H1}$ to $T_{H4}$.

The comparator COMP is configured using the capacitor Cm, inverter INVC, buffer BUF, and switches SW1 to SW4. The comparator COMP can be arranged while suppressing an increase in circuit scale.

Figure 8A:
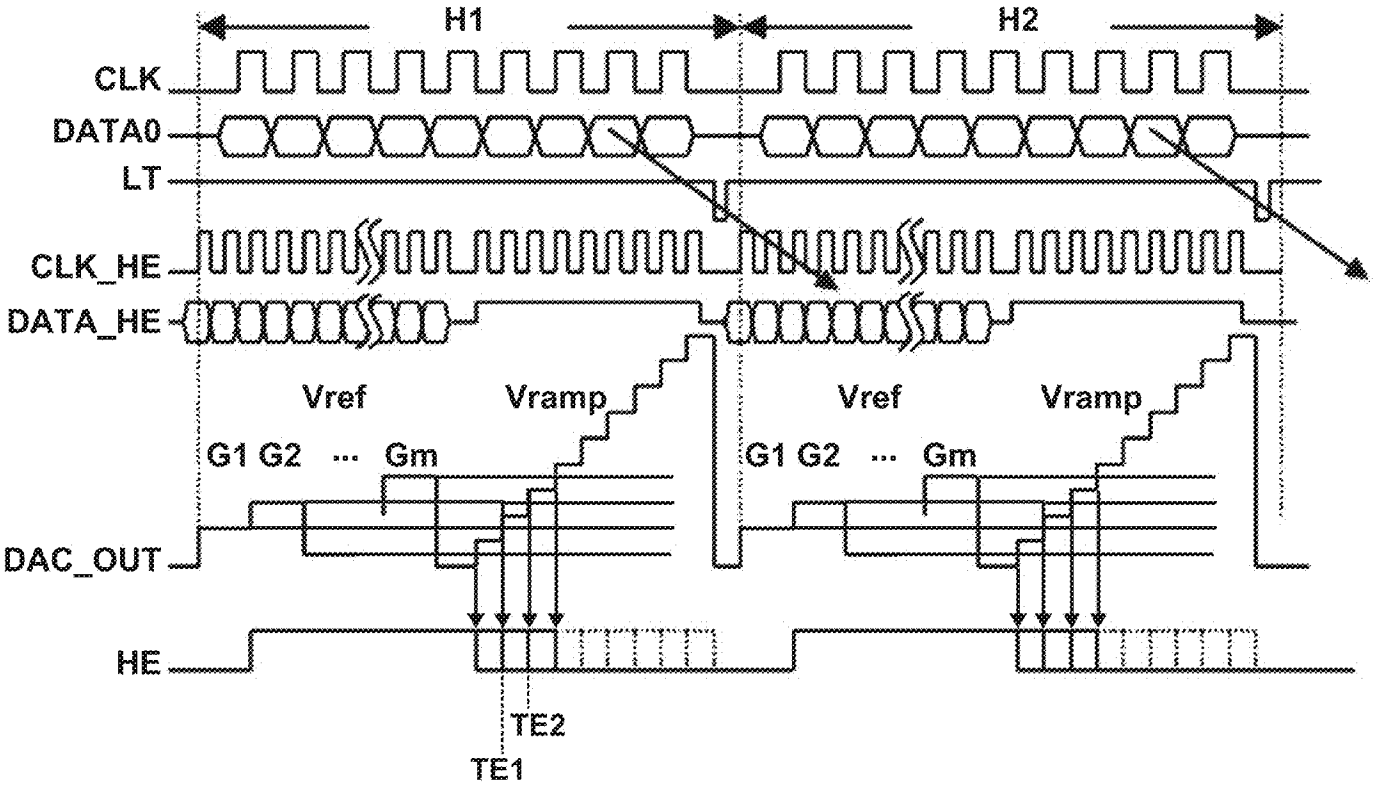
FIGS. 8A and 8B are timing charts for explaining an example of a timing chart for driving the printhead substrate according to the first embodiment.

Next, control signals and data to be handled by the substrate $\mathbf{100}_1$ will be explained with reference to FIGS. 8A and 8B. FIG. 8A shows a timing chart for two cycles (cycles H1 and H2), in which the abscissa represents the time. A series of operations to determine the pulse width of the heat enable signal HE corresponding to each group G is defined as one cycle. An upper portion along the ordinate of FIG. 8A represents the clock signal CLK, print data DATA0, and latch signal LT. A lower portion represents a clock signal CLK_HE and heat enable data DATA_HE. The clock signal CLK_HE is input to the shift register/latch circuit SR/LT2, and used to set the reference voltage Vref and generate the ramp signal Vramp. The heat enable data DATA_HE contains data to set the reference voltage Vref and generate the ramp signal Vramp. A still lower portion represents an output value DAC_OUT of the D/A converter DAC, and the heat enable signal HE generated by the comparator COMP. This cycle corresponds to a cycle for selecting the printing elements ME. The following explanation shows a case for driving the printing elements ME of each of groups G1 to Gm in sequence, as an example. In the cycle H1, the heat enable signal HE which corresponds to the printing element ME1 of each of groups G1 to Gm, is generated. In the cycle H2, the heat enable signal HE which corresponds to the printing element ME2 of each of groups G1 to Gm, is generated. In the next cycle which is not shown in FIG. 8A, the heat enable signal HE which corresponds to the printing element ME3 of each of groups G1 to Gm, is generated. In the same way, the heat enable signals HE which correspond to the printing element ME4 to $ME^{2n}$ are generated, in sequence. After the heat enable signal HE which corresponds to the printing element $ME^{2n}$ is generated, the heat enable signal HE which corresponds to the printing element ME1 is generated again. Note that the order for driving the printing element ME of each of groups G1 to Gm is not limited to the order of the arrangement of the printing element ME, and the driving order can be changed into an order different from the arrangement of the printing element ME (for example, the printing element ME1, ME8, ME3 . . . ).

The print data DATA0 contains normal print data (for example, print data DATA in the reference example), and the heat enable data DATA_HE. If necessary, part of the print data DATA0 may contain another data.

For example, in the cycle H1, after the print data DATA0 of one cycle is transmitted, the latch signal LT is input to latch the print data DATA0 in the shift register/latch circuit SR/LT1. In the next cycle H2, the heat enable data DATA_HE of the cycle H1 is latched in the shift register/latch circuit SR/LT2. The heat enable data DATA_HE is used to set the reference voltage Vref and generate the ramp signal Vramp in accordance with the clock signal CLK_HE. The reference voltage Vref is set for each group G. For example, at timing TE1, the ramp signal Vramp exceeds the output value of the D/A converter DAC of group 1 (G1). At timing TE1, the HE signal of group 1 changes from the high state to the low state. Similarly, at timing TE2, the ramp signal Vramp exceeds the output value of the D/A converter DAC of group 2 (G2). At timing TE2, the HE signal of group 2 changes from the high state to the low state.

Figure 8B:
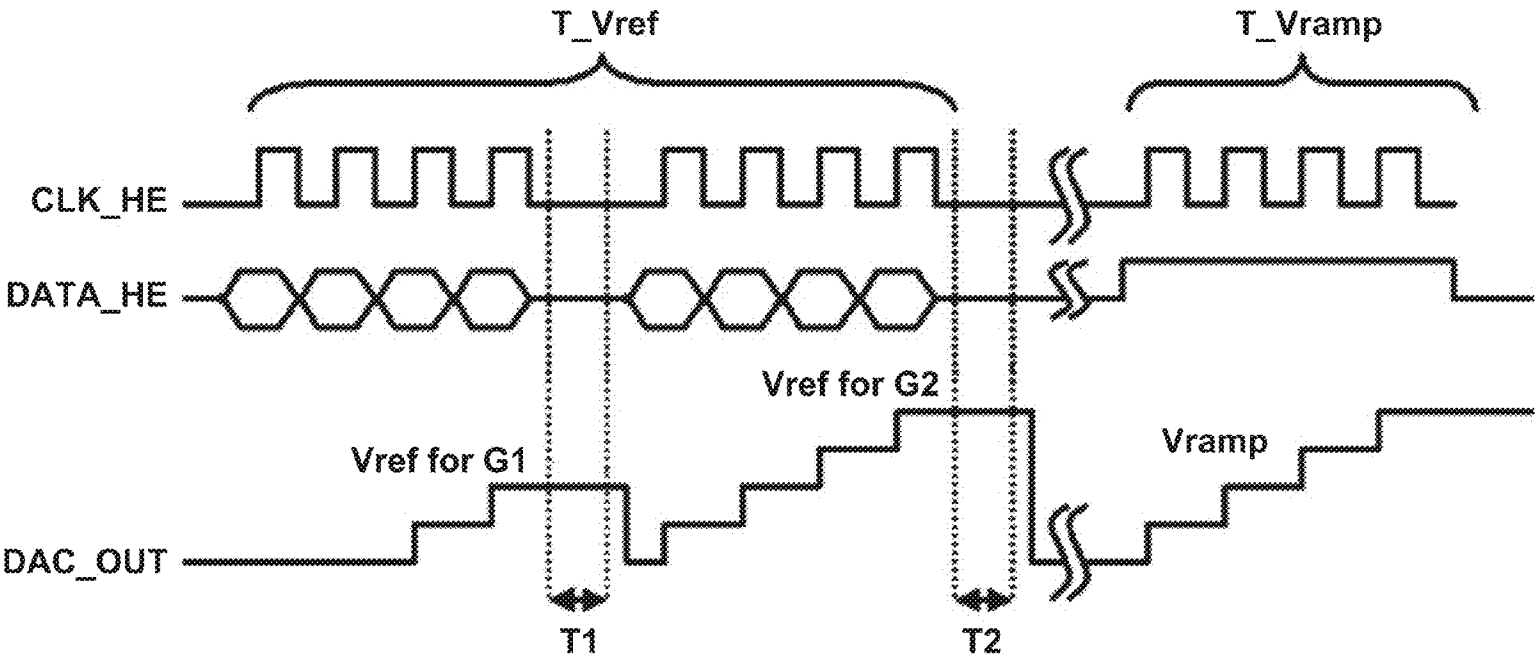

FIG. 8B shows the waveforms of the heat enable data DATA_HE, clock signal CLK_HE, reference voltage Vref for each group G, and ramp signal Vramp. In this case, the reference voltage Vref for each group G is set to one of Vref1 to Vref4 (four stages) in accordance with the heat enable data DATA_HE. For example, in a period T1 after the reference voltage Vref of the group G1 is determined in a period T_Vref, the reference voltage Vref is input to the comparator COMP1 shown in FIG. 6 via a corresponding switch. This also applies to the groups G2 to Gm. In a period T_Vramp, the ramp signal Vramp is generated based on the heat enable data DATA_HE (always in the high state) in accordance with the clock signal CLK_HE. The ramp signal Vramp is input to the respective comparators COMP1 to COMPn via corresponding switches. The resolution of the ramp signal Vramp can be appropriately changed in accordance with, for example, the frequency of the clock signal CLK_HE and the arrangement of the D/A converter DAC.

Figure 15:
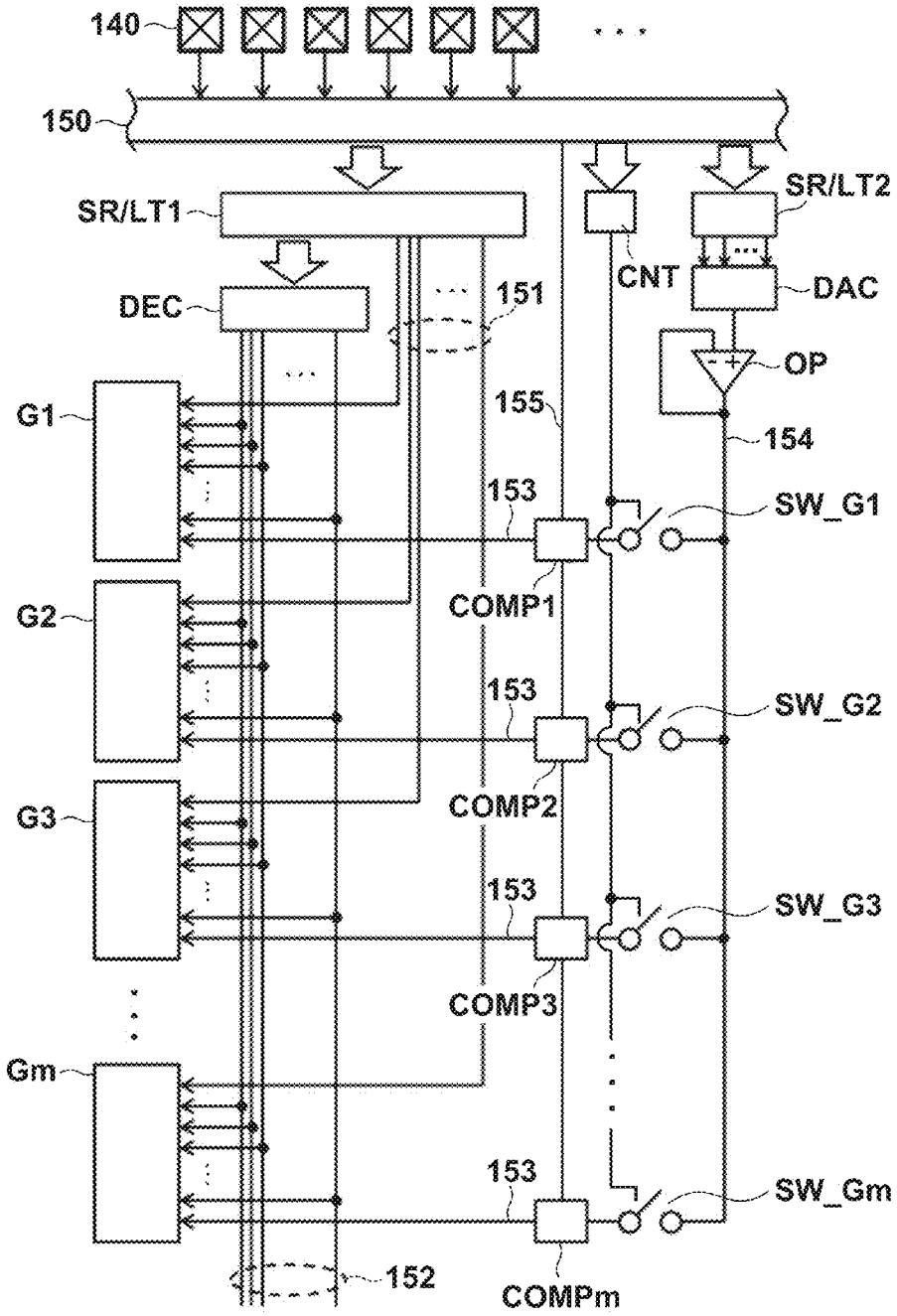
FIG. 15 is a circuit diagram for supplementarily explaining the first embodiment.

Generation of the heat enable signal HE described with reference to FIG. 8A will be supplemented. FIG. 15 is a supplementary view of the arrangement of FIG. 6. The comparator COMP is connected to each group G via the signal line 153. Each comparator generates the heat enable signal HE, and outputs it to a corresponding group. A signal HE_COM is input to the comparators COMP1 to COMPn of the respective groups via a signal line 155. The signal HE_COM is a signal for determining the start timing of the heat enable period. The signal HE_COM is output from the input circuit 150 by using, for example, the latch signal LT as a reference. A counter CNT counts, for example, the number of pulses of the clock signal CLK_HE, and outputs a signal for switching SW_G1 to SW_Gm between connection and disconnection. Note that the counter CNT may be arranged in the shift register/latch circuit SR/LT2. The comparators COMP1 to COMPm of the respective groups receive an analog signal generated by the D/A converter DAC via the signal line 154.

Figure 16A:
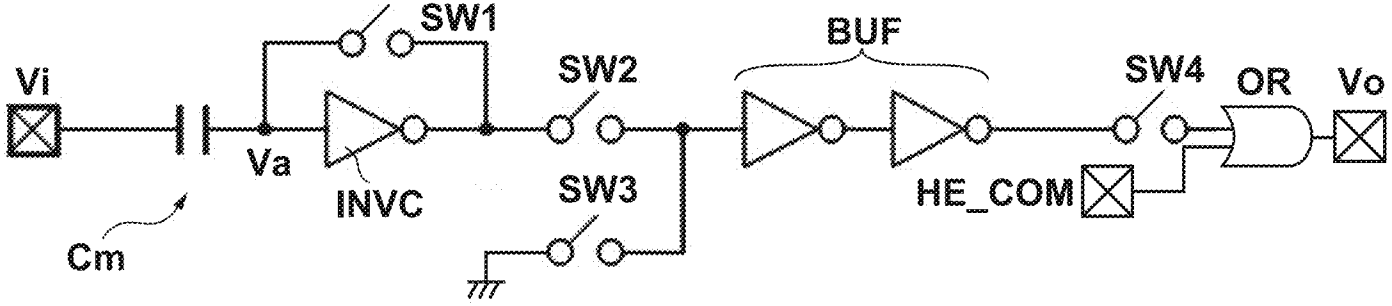
FIGS. 16A and 16B are views for supplementarily explaining the first embodiment.
Figure 16B:
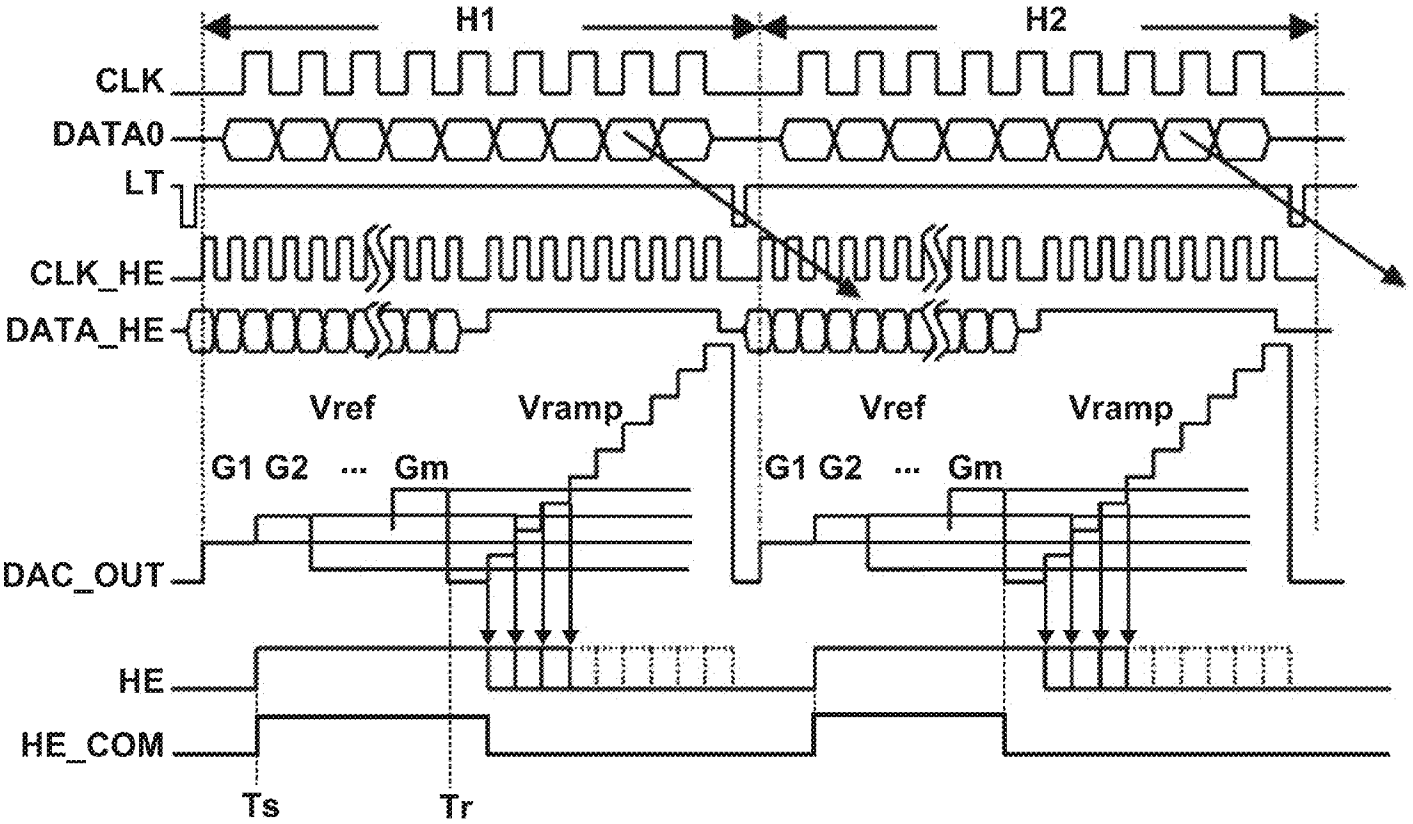

FIGS. 16A and 16B are views for supplementarily explaining the comparator COMP. As shown in FIG. 16A, an OR circuit is interposed between SW4 and the comparator output. The OR circuit ORs the signal HE_COM input from the signal line 155 and an output from the buffer BUF. By the operation of the OR circuit, the heat enable signal HE rises at timing Is when the signal HE_COM rises, generating a high-level heat enable signal HE, as shown in FIG. 16B. The signal HE_COM falls at timing Tr when output of the ramp signal Vramp starts. The timing Tr may be a timing when output of the reference voltage ends. From timing T2, a high-level signal is generated until the voltage of the ramp signal Vramp exceeds the reference voltage Vref. With this arrangement, the timings of the heat enable signals HE to be supplied to the respective groups can coincide with each other.

The ramp signal Vramp is a signal whose voltage value increases stepwise in the embodiment, but is not limited to this waveform. For example, the ramp signal Vramp may be a signal which increases linearly, or a signal which decreases stepwise or linearly.

As described above, according to the first embodiment, the pulse width of the heat enable signal HE (the driving time of the printing element ME) can be set for each group G. It becomes possible to uniform loads on the printing elements ME and uniform ink droplet discharge amounts, thereby preventing characteristic variations of the printing elements ME. The embodiment adopts an arrangement in which the comparators COMP small in circuit scale are arranged along the heater array 120 and the D/A converter DAC large in circuit scale is arranged at the end of the substrate $\mathbf{100}_1$. This can suppress the total area of the substrate $\mathbf{100}_1$. In the embodiment, the ramp signal Vramp and reference voltage Vref are generated using the common D/A converter DAC, suppressing the circuit scale. Since the common D/A converter DAC is used, no characteristic variation need be considered, and digital-to-analog conversion can be performed at high precision.

Second Embodiment

Figure 9:
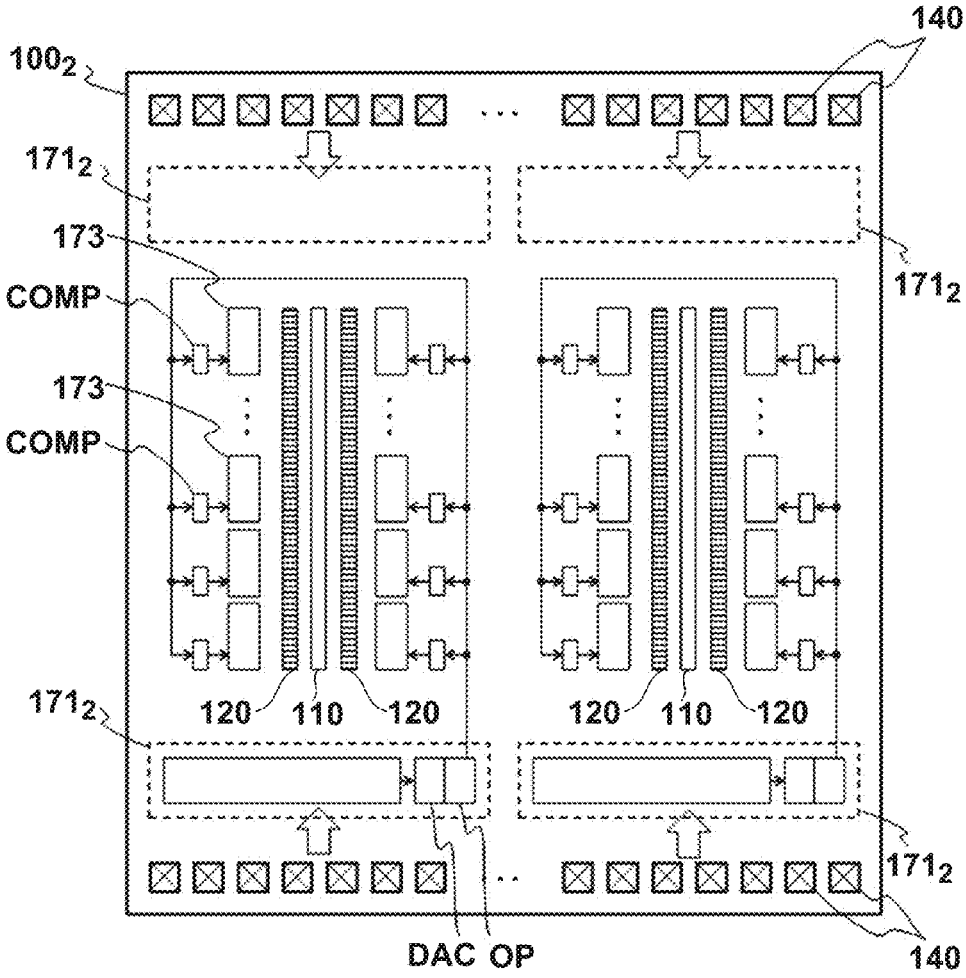
FIG. 9 is a diagram for explaining an example of the arrangement of a printhead substrate according to the second embodiment.

A printhead substrate $\mathbf{100}_2$ (to be referred to as a "substrate $\mathbf{100}_2$" hereinafter) according to the second embodiment will be explained with reference to FIG. 9. The second embodiment is different from the first embodiment in that signal lines for propagating a reference voltage Vref and ramp signal Vramp are arranged along short sides of heater arrays 120 and an ink supply channel 110. More specifically, an input unit $\mathbf{171}_2$ in a control unit 170 includes one D/A converter DAC. The signal lines are arranged along the outer periphery of the arrangement of the heater arrays 120 and ink supply channel 110 so that the output of the D/A converter DAC is connected to all comparators COMP arranged on the two sides of the ink supply channel 110 and two heater arrays 120.

When the operation described in the first embodiment can be followed in accordance with the cycle of a clock signal CLK, one D/A converter DAC may cope with the comparators COMP of two lines, as described above. This arrangement may be employed in accordance with the scale such as the circuit scale, wiring capacitance, and data amount to be handled. Further, one D/A converter DAC may cope with the comparators COMP of three or more lines. This can suppress an increase in the area of the substrate $\mathbf{100}_2$. To the contrary, when the scale is large, the comparators COMP of one line may be divided. For example, one D/A converter DAC may correspond to the comparators COMP of a ½ or ⅓ line. In this way, while suppressing an increase in the area of the substrate $\mathbf{100}_2$, the second embodiment can obtain the same effects as those of the first embodiment such as prevention of characteristic variations of a plurality of printing elements ME.

Third Embodiment

Figure 10:
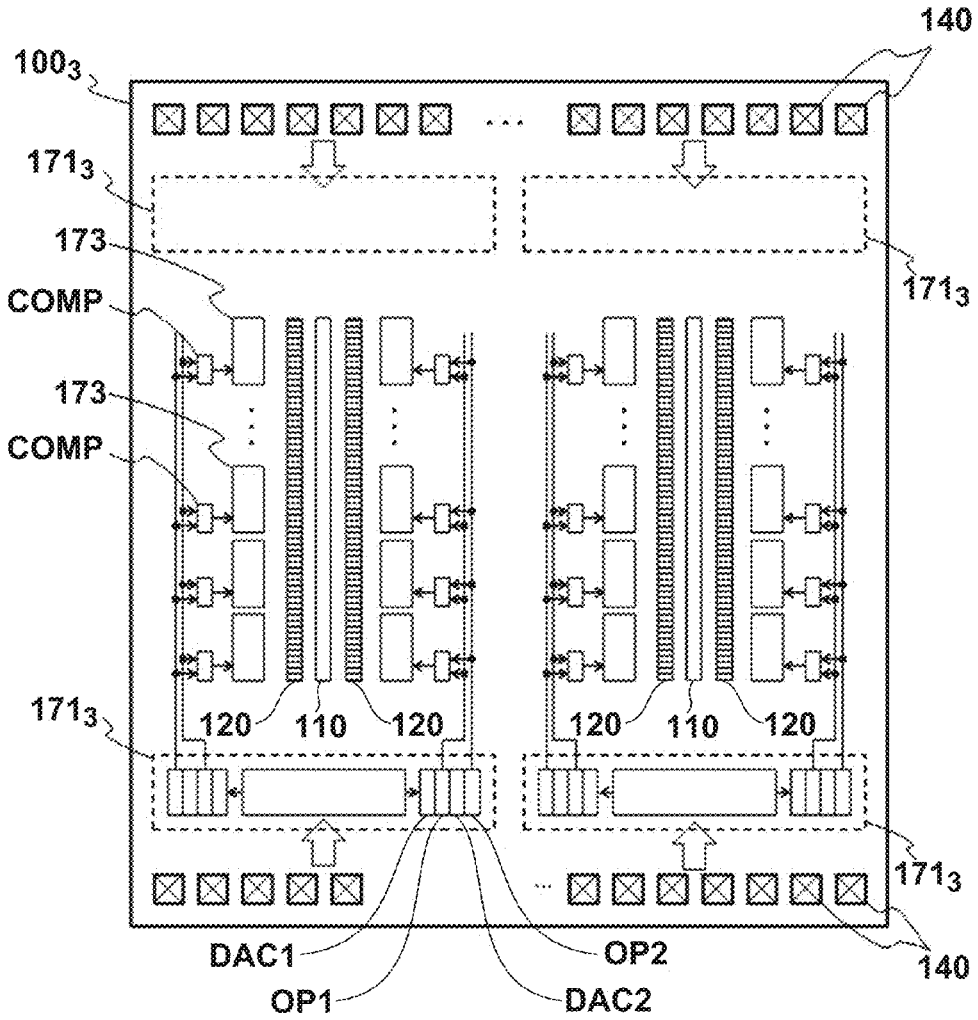
FIG. 10 is a diagram for explaining an example of the arrangement of a printhead substrate according to the third embodiment.

A printhead substrate $\mathbf{100}_3$ (to be referred to as a "substrate $\mathbf{100}_3$" hereinafter) according to the third embodiment will be explained with reference to FIGS. 10 to 12. FIG. 10 is a block diagram schematically showing the arrangement of the substrate $\mathbf{100}_3$. In the third embodiment, an input unit $\mathbf{171}_3$ in a control unit 170 includes a D/A converter DAC1 (first D/A converter) and D/A converter DAC2 (second D/A converter) which are different from each other. The third embodiment is different from the first embodiment in that setting of a reference voltage Vref and generation of a ramp signal Vramp are performed individually. In the input unit $\mathbf{171}_3$, operational amplifiers OP1 and OP2 are arranged in correspondence with the D/A converters DAC1 and DAC2.

Figure 11:
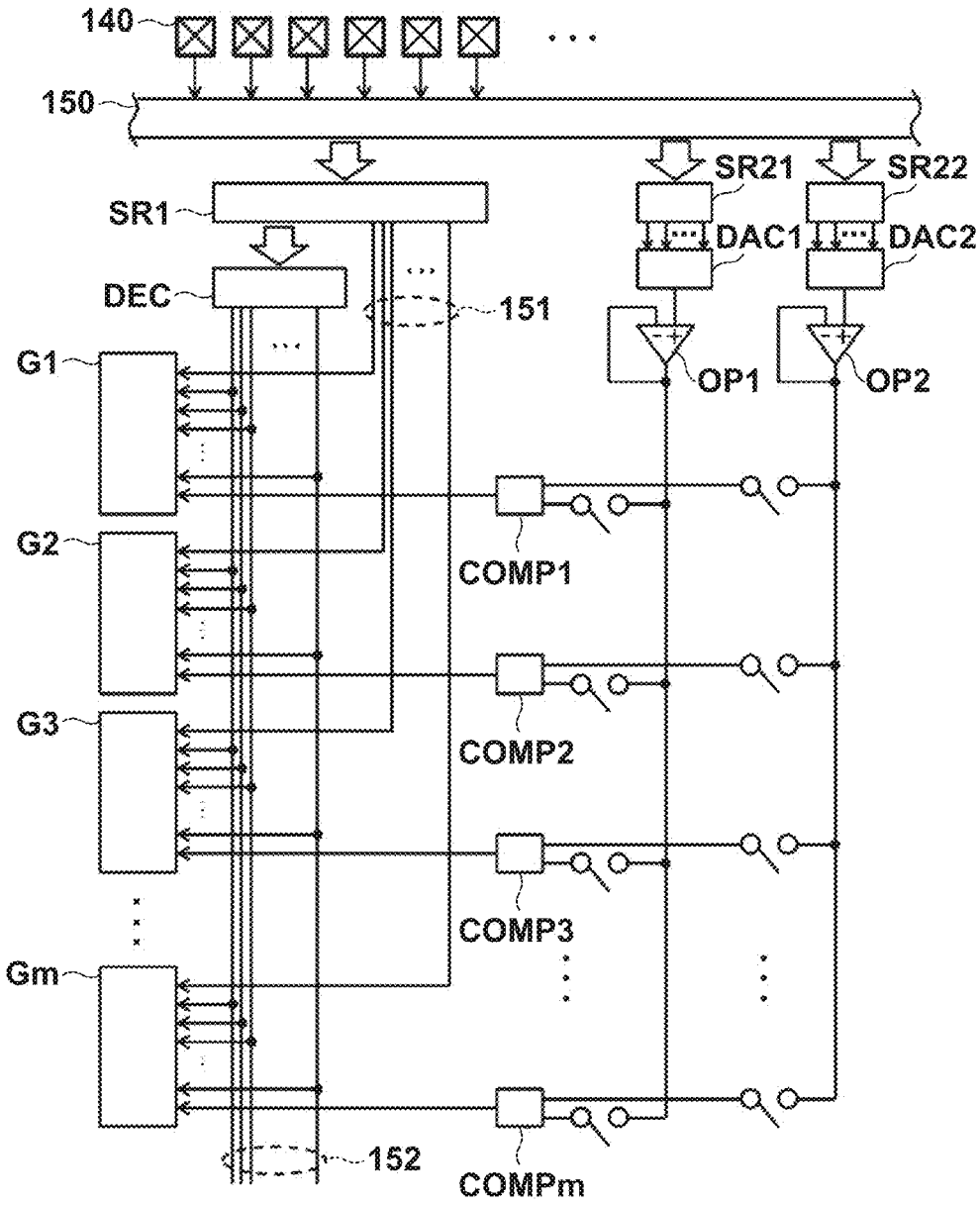
FIG. 11 is a circuit diagram for explaining an example of the circuit arrangement of the printhead substrate according to the third embodiment.
Figure 12:
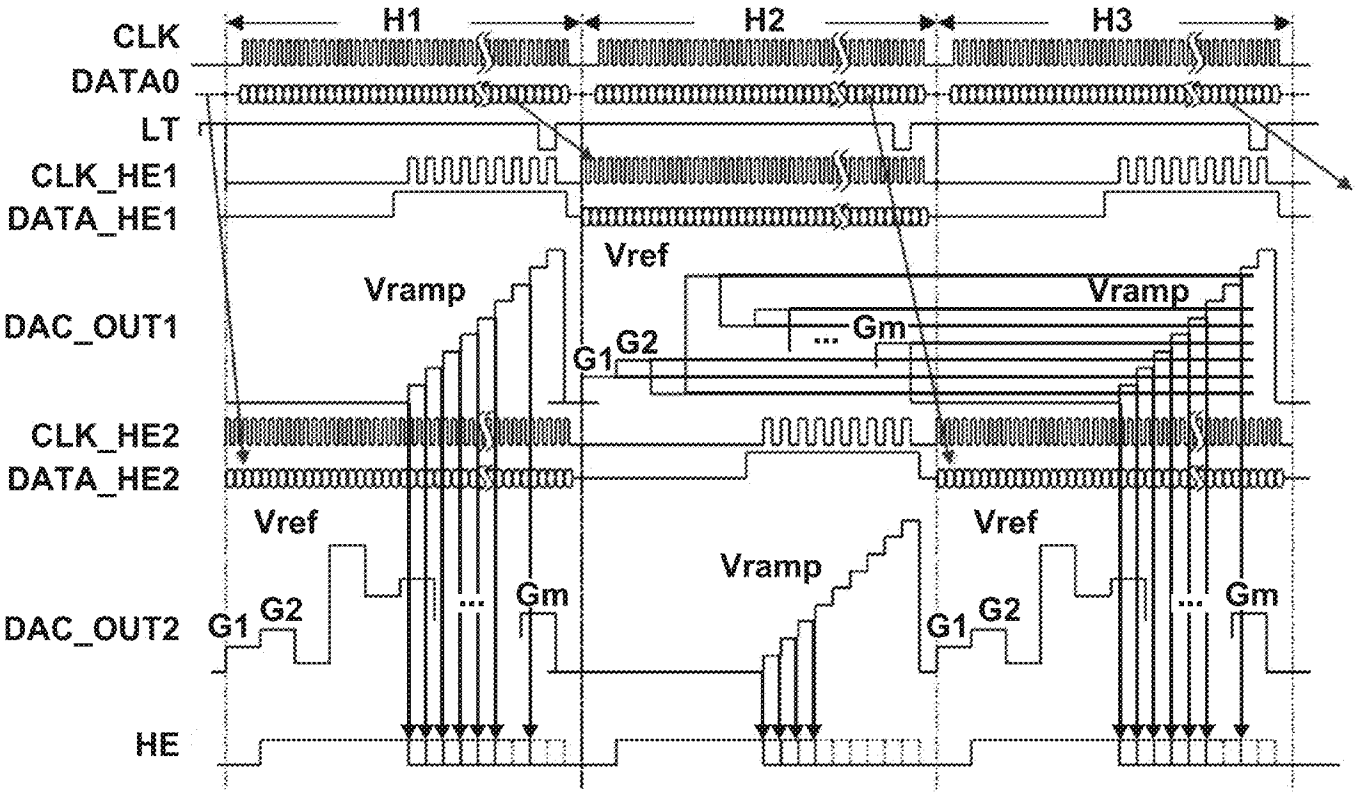
FIG. 12 is a timing chart for explaining an example of a timing chart for driving the printhead substrate according to the third embodiment.

Similar to FIG. 6, FIG. 11 schematically exemplifies the circuit arrangements of the control unit 170 and a plurality of groups G according to the third embodiment. As exemplified in FIG. 11, a shift register SR21, the D/A converter DAC1, and the operational amplifier OP1, and a shift register SR22, the D/A converter DAC2, and the operational amplifier OP2 are arranged parallelly. Outputs from the operational amplifiers OP1 and OP2 are input to comparators COMP1 to COMPm, respectively. In the third embodiment, two circuit arrangements exemplified in FIG. 7A are preferably prepared parallelly for each comparator COMP, and alternately repeat setting of the reference voltage Vref (state in FIG. 7B) and generation of the ramp signal Vramp (state in FIG. 7C).

Control signals and data to be handled by the substrate $\mathbf{100}_3$ will be explained with reference to FIG. 12. FIG. 12 shows a timing chart for three cycles (cycles H1 to H3), similar to FIG. 8A. A clock signal CLK_HE1 is input to the shift register SR21, and used to set the reference voltage Vref and generate the ramp signal Vramp. Based on heat enable data DATA_HE1 stored in the shift register SR21, setting of the reference voltage Vref and generation of the ramp signal Vramp are performed in accordance with the clock signal CLK_HE1. FIG. 12 shows an output value DAC_OUT1 of the D/A converter DAC1 according to this operation below the clock signal CLK_HE1 and the heat enable data DATA_HE1. This also applies to a clock signal CLK_HE2, heat enable data DATA_HE2, and an output value DAC_OUT2 of the D/A converter DAC2.

As exemplified in FIG. 11, the first and second paths are formed between an input circuit 150 and each comparator COMP. The first path includes the shift register SR21, D/A converter DAC1, and operational amplifier OP1, and the second path includes the shift register SR22, D/A converter DAC2, and operational amplifier OP2. As shown in FIG. 12, setting of the reference voltage Vref of each group G and generation of the ramp signal Vramp can be alternately performed via the first and second paths. According to the third embodiment, the two D/A converters DAC1 and DAC2 alternately convert an input digital signal into the first analog signal and second analog signal, respectively. This arrangement can also increase the amount of data (including print data DATA0) processible in one cycle. In this fashion, while ensuring the data processing amount, the third embodiment can obtain the same effects as those of the first embodiment such as prevention of characteristic variations of a plurality of printing elements ME.

Fourth Embodiment

Figure 13:
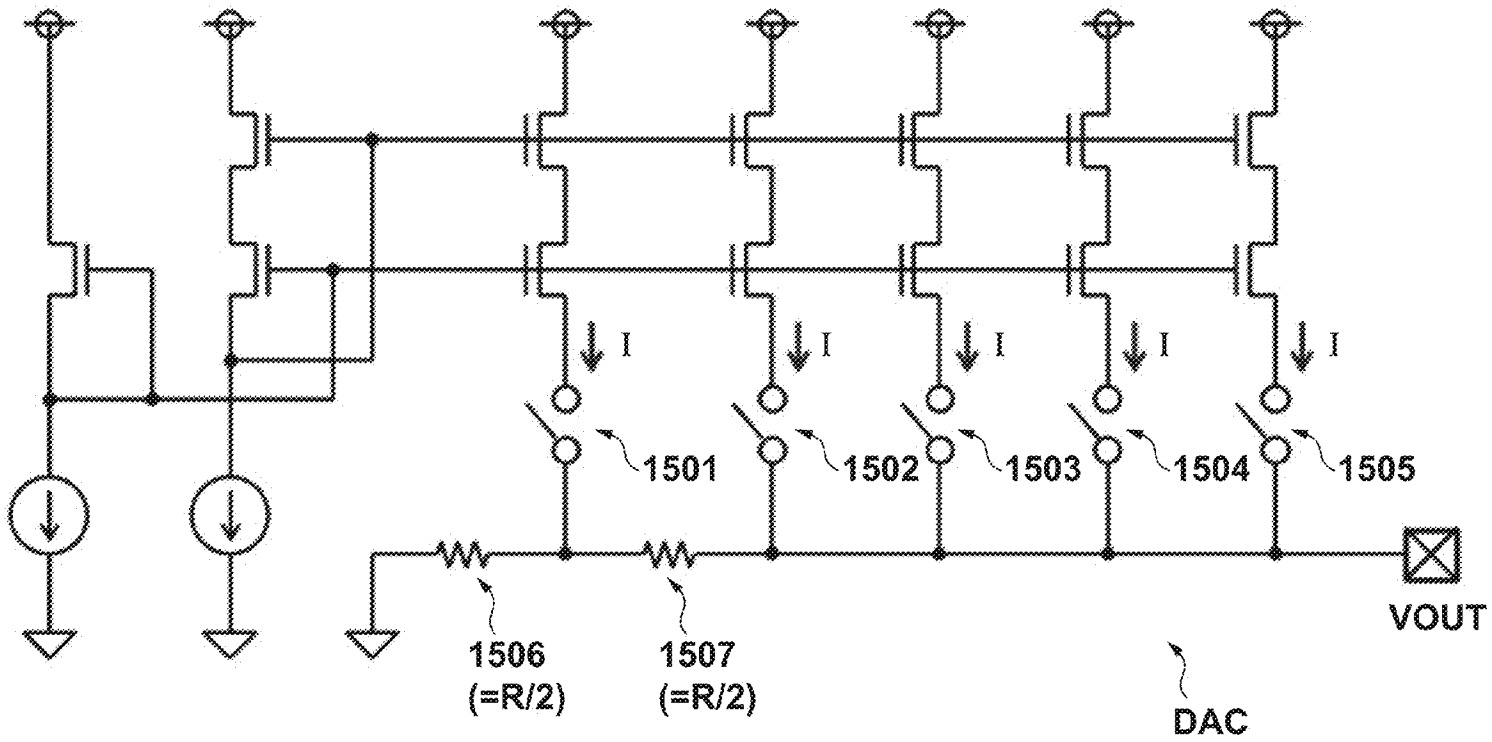
FIG. 13 is a circuit diagram for explaining an example of the arrangement of a D/A converter according to the fourth embodiment.
Figure 14:
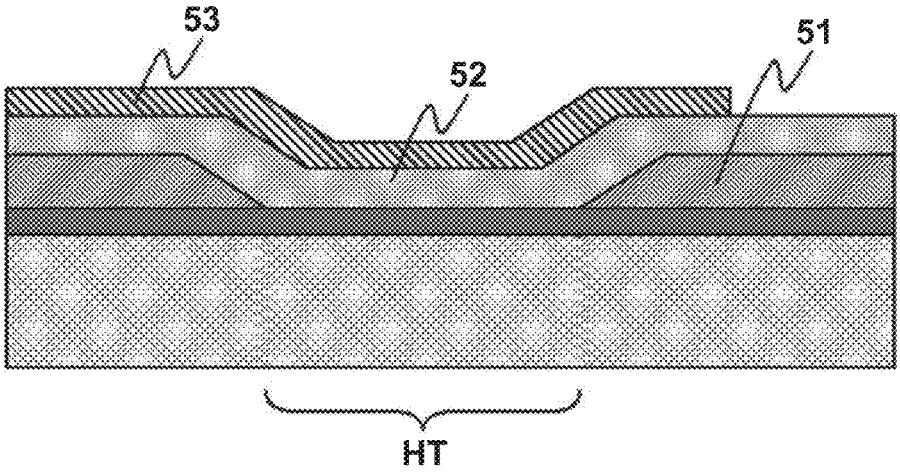
FIG. 14 is a view for explaining an example of the arrangement of the heater of a printing element.

The fourth embodiment will be explained with reference to FIG. 13. FIG. 13 exemplifies the arrangement of a D/A converter DAC (including DAC1 and DAC2) usable in the first to third embodiments. The D/A converter DAC converts a digital signal into an analog signal. More specifically, switches 1501 to 1505 are turned on (conductive state) and off (non-conductive state) in accordance with an input digital signal or a signal complying with the digital signal.

The D/A converter DAC uses a current mirror circuit, controls switches corresponding to respective bits to adjust currents flowing through resistors 1506 to 1507, and generates a desired voltage to generate an analog signal. The resistors 1506 and 1507 are series-connected between a reference terminal (for example, ground node) and an output terminal VOUT. A circuit arrangement on the reference side is not limited to the arrangement of the fourth embodiment.

When the switch 1502 is turned on, a current I flows, and a voltage of $(R/2+R/2)\times I=RI$ is output from the output terminal VOUT. Further, when the switch 1503 is turned on, a voltage 2RI is output. When the switch 1504 is turned on, a voltage 3RI is output. When the switch 1505 is turned on, a voltage 4RI is output. By switching the switches 1502 to 1505 between the ON state and the OFF state, a desired voltage is generated to generate an analog signal.

For example, in the first to third embodiments, the ramp signal Vramp can be generated by sending DATA_HE in the high state. Thus, the switches may be turned on in order from the switch 1502 to the switch 1505. This arrangement prevents generation of a glitch, prevents an operation error of comparison between the generated ramp signal Vramp and the reference voltage Vref, and controls the pulse width of the heat enable signal HE at high precision.

In the first to third embodiments, the ramp signal Vramp uses a waveform which increases the voltage step by step, as exemplified in FIG. 5. The reference voltage Vref is preferably a voltage between steps of the stepwise ramp signal Vramp. For example, when the voltage of one step of the ramp signal is $\Delta V$, the reference voltage preferably becomes $(n+1/2)\times\Delta V$. When the reference voltage Vref and ramp signal Vramp are generated by the common D/A converter DAC, they are preferably generated to shift from each other by $\Delta V/2$. Considering this, the resistor is divided into the resistor 1506 (first resistor) and the resistor 1507 (second resistor) (each resistance value is, for example, R/2), and the switch 1501 (first switch) is interposed between them. The reference voltage Vref becomes RI/2 when, for example, only the switch 1501 is ON. The reference voltage Vref becomes 3RI/2 when, for example, the switches 1501 and 1502 are ON. By sequentially switching the switches 1502 to 1505 (second switches) to the ON state, voltages VOUT of RI/2, 3RI/2, 5RI/2, and 7RI/2 can be output.

In a mode in which the ramp signal Vramp is generated, the D/A converter DAC sets the switch 1501 to either the ON or OFF state (OFF state in this case). In a mode in which the reference voltage Vref is generated, the D/A converter DAC sets the switch 1501 to the other state (ON state in this case). In this manner, the D/A converter DAC sets the reference voltage Vref and the voltage of the ramp signal Vramp to have different values (for example, shift from each other by $\Delta V/2$).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-120135, filed May, 25, 2012, which is hereby incorporated by reference herein in its entirety.

What is claimed is:

1. A printing element substrate comprising:

a plurality of printing elements, which are arrayed in a predetermined direction, forming a plurality of groups;

a first generating unit configured to generate a threshold signal which is set for each of the plurality of groups and a ramp signal, based on an externally received digital signal; and second generating units, which are arranged in correspondence with the respective groups, configured to generate, based on the ramp signal and the threshold signal, enable signals for setting a period during which the printing element is driven, wherein the first generating unit includes a D/A converter, which is configured to convert a digital signal into an analog signal, arranged between the plurality of printing elements and an outer edge of the substrate in the predetermined direction, and wherein the second generating units include a plurality of comparators which are arranged in correspondence with the respective groups and along the predetermined direction.

2. The substrate according to claim 1, wherein the D/A converter converts the digital signal into the threshold signal and the ramp signal.

3. The substrate according to claim 2, wherein the D/A converter converts the digital signal into the threshold signal and the ramp signal in each cycle for determining a pulse width of the enable signal.

4. The substrate according to claim 1, further comprising a reception unit configured to receive a driving start signal of the printing element, wherein the second generating unit starts generation of the enable signal based on a reception timing of the driving start signal.

5. The substrate according to claim 1, wherein the second generating unit stops generation of the enable signal when a voltage value of the ramp signal exceeds a voltage value of the threshold signal.

6. The substrate according to claim 1, wherein the ramp signal includes a signal whose voltage value increases or decreases with a lapse of time.

7. A printhead comprising a printing element substrate defined in claim 1.

8. A printing apparatus comprising:

a printhead defined in claim 7; and a control unit configured to control a driving start signal.

* * * * *